US009002231B2

(12) United States Patent
Jung

(10) Patent No.: US 9,002,231 B2
(45) Date of Patent: Apr. 7, 2015

(54) IMAGE FORMING APPARATUS WITH GUIDE MEMBER TO GUIDE AIR

(75) Inventor: Seung-bok Jung, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 301 days.

(21) Appl. No.: 13/242,595

(22) Filed: Sep. 23, 2011

(65) Prior Publication Data

US 2012/0155913 A1 Jun. 21, 2012

(30) Foreign Application Priority Data

Dec. 21, 2010 (KR) ..... 10-2010-0131332

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 2221/1645; G03G 21/0052
USPC ..... 399/92, 93, 94, 96; 361/679.49, 679.5, 361/692
See application file for complete search history.

(56) References Cited

U.S. PATENT DOCUMENTS

| | | | | |
|---|---|---|---|---|
| 4,720,727 | A | 1/1988 | Yoshida | |
| 6,308,024 | B1 * | 10/2001 | Nakayama et al. | 399/98 |
| 2003/0012582 | A1 * | 1/2003 | Sameshima et al. | 399/111 |
| 2006/0284960 | A1 | 12/2006 | Kishi | |
| 2007/0065170 | A1 | 3/2007 | Kimura | |
| 2007/0183808 | A1 * | 8/2007 | Jeon | 399/92 |
| 2008/0063425 | A1 * | 3/2008 | Idehara et al. | 399/93 |
| 2008/0094799 | A1 * | 4/2008 | Zieman et al. | 361/695 |
| 2012/0033379 | A1 * | 2/2012 | Lam et al. | 361/695 |

OTHER PUBLICATIONS

Extended European Search Report dated Jun. 6, 2012 issued in EP Application No. 11177374.3.

* cited by examiner

*Primary Examiner* — David Gray
*Assistant Examiner* — Sevan A Aydin
(74) *Attorney, Agent, or Firm* — Staas & Halsey LLP

(57) ABSTRACT

An image forming apparatus includes an image forming unit to form an image on a print medium, a fixing unit to fix the image formed by the image forming unit on the print medium, and a guide member installed in a moving path where air moves along between the image forming unit and the fixing unit so that air inhaled through an inhaling unit formed at one side of a main frame can be exhausted to an exhaust unit formed at the other side of the main frames, and to guide a moving direction of the air so that the air inhaled through the inhaling unit can move to the image forming unit along the moving path.

23 Claims, 7 Drawing Sheets

IMAGE FORMING APPARATUS WITH GUIDE MEMBER TO GUIDE AIR

CROSS-REFERENCE TO RELATED APPLICATIONS

This application claims the benefit of priority under 35 U.S.C. §119 to Korean Patent Application No. 10-2010-0131332, filed on Dec. 21, 2010 in the Korean Intellectual Property Office, the disclosure of which is incorporated herein by reference in its entirety.

BACKGROUND OF THE INVENTION

1. Field of the Invention

The present general inventive concept generally relates to an image forming apparatus which forms an image with a developer on a print medium, and more particularly, to an image forming apparatus having an improved cooling structure to discharge heat generated inside the apparatus to the outside.

2. Description of the Related Art

An image forming apparatus performs a printing job for forming a visible image with a developer, ink or the like on a print medium, and generally includes a printer, a copier, a multi-function printer (MFP), etc. In the case where the image forming apparatus forms an image based on the developer, an image forming unit forms a visual image with a developer on a print medium, and a fixing unit fixes the image formed by the image forming unit on the print medium.

Such an image forming apparatus inevitably generates heat from the inside thereof when performing a printing job. In particular, temperature around the fixing unit becomes significantly higher due to fixing heat generated by the fixing unit. However, the developer is vulnerable to temperature because of its chemical properties, so that the developer or waste developer may be solidified when the inner temperature of the apparatus becomes higher. Such solidification of the developer or waste developer has an effect on operation of the image forming unit or transfer of the developer, thereby causing failure in the apparatus and a defective image.

Conventionally, the image forming apparatus includes an inhaling port through which external cool air is introduced in and an exhaust port through which internal hot air is discharged out. With this configuration, if the inhaling port and the exhaust port are arranged near the fixing unit, the fixing unit may have a non-uniform temperature since a region adjacent to the inhaling port and a region adjacent to the exhaust port are different in temperature. In this case, faulty fixing may arise due to a non-uniform fixing temperature.

SUMMARY OF THE INVENTION

The present general inventive concept provides an image forming apparatus having a simple structure to lower an inner temperature thereof.

The present general inventive concept also provides an image forming apparatus capable of minimizing non-uniformity in temperature of a fixing unit even though cool air is introduced from the outside to lower the inner temperature of the apparatus.

Aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a main frame, a medium feeding unit supported by the main frame and to supply a print medium, an image forming unit supported by the main frame and to form an image on the print medium supplied by the medium feeding unit, a fixing unit supported by the main frame and to fix the image formed by the image forming unit on the print medium, and a guide member installed in a moving path where air moves along between the image forming unit and the fixing unit so that air inhaled through an inhaling unit formed at one side of the main frame can be exhausted to an exhaust unit formed at the other side of the main frames, and to guide a moving direction of the air so that the air inhaled through the inhaling unit moves to the image forming unit along the moving path.

The moving path may be formed between the image forming unit and the fixing unit along a lengthwise direction of at least one of the image forming unit and the fixing unit.

The guide member may include a plurality of ribs to guide air inhaled through the inhaling unit to be distributed into a plurality of regions of the image forming unit along the lengthwise direction of the image forming unit.

The plurality of ribs may be extended to respectively have different angles with respect to a first line parallel to an extended direction of the moving path.

Each rib may include a first guide unit arranged at a side of the inhaling unit, and a second guide unit bent from the first guide unit toward the image forming unit, and the second guide units of the respective ribs may have different extending angles with respect to the first line.

The first guide unit of each rib may extend in parallel with the extending direction of the moving path.

The first guide units of the respective ribs may extend to have different angles with respect to the first line, and the extending angle of the second guide unit of each respective rib may be larger than the corresponding extending angle of the first guide unit of each respective one rib.

Each of the plurality of ribs may have one end arranged along a second line perpendicular to the first line, the second line being parallel to a carrying direction of the print medium.

The extending angle of each rib with respect to the first line may become larger as the rib gets closer to the image forming unit.

The plurality of ribs may be bent and extended as being rounded toward the image forming unit, and an angle between a tangent line of each rib and the first line may become larger as the rib gets closer to the image forming unit.

The image forming unit may include a developing unit including an image carrying body on which a latent image is formed, arranged in parallel with the fixing unit, and to form an image with a developer on the image carrying body, and a light scanning unit installed above the developing unit and to form a latent image based on image data on the image carrying body, and the moving path may be formed under the light scanning unit.

The moving path may be extended in the form of a substantially straight line between the developing unit and the fixing unit along a lengthwise direction of at least one of the developing unit and the fixing unit.

The image forming apparatus may further include a medium carrying frame installed under the moving path and supporting the print medium carried from the developing unit to the fixing unit, wherein the guide member is coupled to the medium carrying frame.

The exhaust unit may be installed at a position relatively higher than the inhaling unit.

The image forming apparatus may further include a power supply installed under the medium carrying frame and to supply power, wherein the inhaling unit is arranged at a height to supply air inhaled from an exterior to the moving path and the power supply.

The exhaust unit may be arranged at a height to exhaust air from the moving path and the light scanning unit to an exterior of the image forming apparatus.

The main frame may include a first frame supporting one end of the image forming unit and the fixing unit, and a second frame facing the first frame and supporting the other ends of the image forming unit and the fixing unit, and the inhaling unit and the exhaust unit may be installed in the first frame and the second frame, respectively.

At least one of the inhaling unit and the exhaust unit may include a blowing fan to move air through the moving path.

The foregoing and/or other aspects and utilities of the present general inventive concept may be achieved by providing an image forming apparatus including an inhaling unit to transfer air from an exterior of the image forming apparatus to an interior of the image forming apparatus in a direction substantially perpendicular to a side of the image forming apparatus, and a plurality of guide ribs disposed in the interior of the image forming apparatus in a path of the air transferred by the inhaling unit, each of the plurality of guide ribs having a portion angled with respect to the side of the image forming apparatus to change the direction of the air transferred by the inhaling unit.

The image forming apparatus may include an image forming unit to form an image on a print medium and disposed in the interior of the image forming apparatus such that the plurality of guide ribs change the direction of the air to be toward the image forming unit, and a fixing unit to fix the image formed by the image forming unit to the print medium and disposed in the interior of the image forming apparatus such that the plurality of guide ribs change the direction of the air to be away from the fixing unit.

Each of the plurality of guide ribs may include a first guide portion having a first end facing the inhaling unit and a second end facing away from the inhaling unit, and a second guide portion connected to the second end of the first guide portion and extending at an angle with respect to the side of the image forming apparatus to change the direction of the air according to the angle, wherein the angle of each respective second guide portion is different.

Each respective first guide portion may extend in a direction substantially perpendicular to the side of the image forming apparatus.

Each respective first guide portion may extend at different angles with respect to the side of the image forming apparatus.

T plurality of ribs may each include a first end facing the inhaling unit and extend in a curved shape away from the inhaling unit to change the direction of the air according to a curvature of the curved shape, wherein the curvature of each respective guide rib is different.

The foregoing and/or other aspects and utilities of the present general inventive concept may be achieved by providing an image forming apparatus including an inhaling unit to move air from an exterior of the image forming apparatus to an interior of the image forming apparatus in a direction substantially perpendicular to a side of the image forming apparatus, and a guide member disposed in the interior of the image forming apparatus such that the air transferred by the inhaling unit enters the guide member moving in the direction substantially perpendicular to the side of the image forming apparatus and exits the guide member moving in a plurality of different directions angled with respect to the side of the image forming apparatus.

The guide member may include a plurality of guide ribs, each of the plurality of guide ribs including at least one guide portion disposed at a different angle with respect to the side of the image forming apparatus to deflect the direction of the air to one of the plurality of different directions.

Each of the plurality of guide ribs may include a plurality of guide portions extending end to end from an entrance of the guide member to an exit of the guide member and arranged in an increasing order of angles with respect to the side of the image forming apparatus from the entrance of the guide member to the exit of the guide member and the moving direction of the air exiting the guide member corresponds to the angle of the guide portion nearest the exit of the guide member.

The plurality of guide ribs may have curved shapes extending from an entrance of the guide member to an exit of the guide member and having different curvatures.

The image forming apparatus may include an image forming unit to form an image on a print medium and disposed in the interior of the image forming apparatus such that the plurality of different directions are each toward the image forming unit, and a fixing unit to fix the image formed by the image forming unit to the print medium and disposed in the interior of the image forming apparatus such that the plurality of different directions are each away from the fixing unit.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
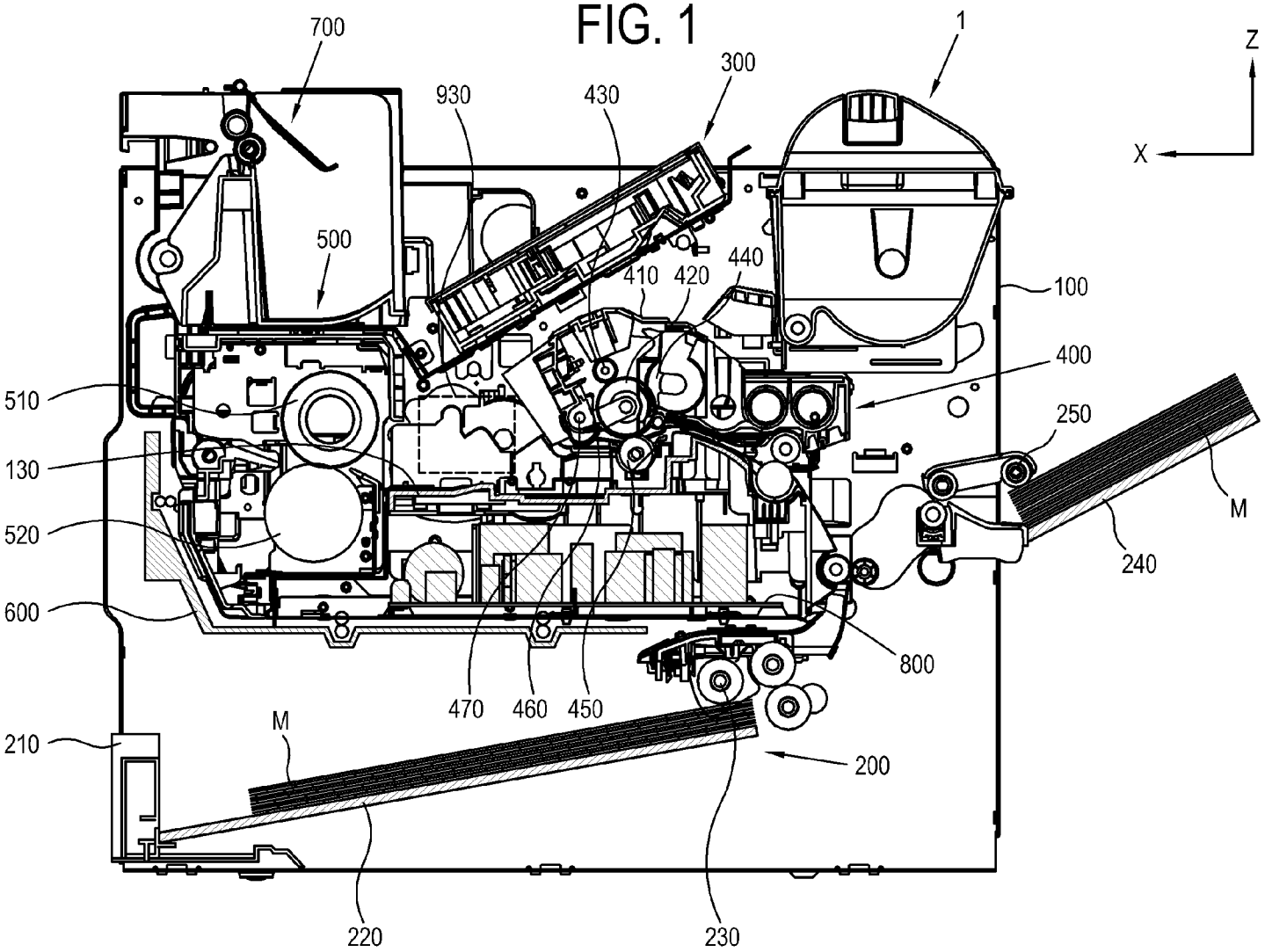
FIG. 1 is a lateral cross-section view of an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

FIG. 1 is a lateral cross-section view of an image forming apparatus 1 according to an exemplary embodiment of the present general inventive concept.

As illustrated in FIG. 1, the image forming apparatus 1 in this exemplary embodiment is illustrated as a printer for forming a mono-color image, but the present general inventive concept is not limited thereto. Alternatively, the image forming apparatus 1 may include a printer for forming color images through a plurality of developers corresponding to colors. The image forming apparatus 1 may also be embodied as a copier, a multi-function printer (MFP), etc.

The image forming apparatus 1 in this exemplary embodiment includes a main frame 100 to support inner elements such as a medium feeding unit 200 to feed a print medium M, a light scanning unit 300, a developing unit 400, and a transfer unit 450 to form an image with a developer on the print medium M, a fixing unit 500 to fix the image formed on the print medium M, a duplex unit 600 to carry the print medium M formed with the image on one side thereof toward the developing unit 400 so that an image can be formed on the other side of the print medium M, a discharging unit 700 to discharge the print medium M formed with a completely formed image to the outside, and a power supply 800 to supply power to operate elements of the image forming apparatus 1. Collectively, the light scanning unit 300, the developing unit 400, and transfer unit 450 form an image forming unit.

Directions illustrated in FIG. 1 are as follows. 'X' indicates a direction where the print medium M is carried from the developing unit 400 to the fixing unit 500, and 'Z' indicates a height direction perpendicular to the direction of 'X'. Although it is not illustrated, 'Y' is a direction perpendicular to both directions of 'X' and 'Z', which also indicates a lengthwise direction of the light scanning unit 300, the developing unit 400, and the transfer unit 450 or the fixing unit 500. FIG. 1 illustrated a lateral cross-section of the image forming apparatus 1 on the 'X-Z' plane.

Hereinafter, drawings including FIG. 1 and embodiments will be based on the above definition about the directions. Further, opposite directions to 'X', 'Y' and 'Z' will be represented by '-X', and '-Z', respectively, and the 'X-Z' plane means a plane formed by axes of 'X' and 'Z'.

The main frame 100 is installed in a housing (not shown) forming an outer appearance of the image forming apparatus 1, which can be embodied by a metal plate formed with various holes and patterns to which elements of the image forming apparatus 1 may be coupled and supported. For example, the main frame 100 includes two frames facing each other so that opposite ends of the light scanning unit 300, the developing unit 400, the transfer unit 450, the fixing unit 500, and like elements can be supported between such two frames.

The medium feeding unit 200 stacks the print medium M such as paper or the like thereon, and feeds the image forming apparatus 1 with one stacked print medium M after another when a printing job starts. The medium feeding unit 200 includes a stacking cassette 210 detachably mounted to the main frame 100 placed in a lower side of the image forming apparatus 1 and accommodating the print medium M therein, a knock-up plate 220 installed in the stacking cassette 210 and supporting the print medium M, and a first pick-up roller 230 supported on the main frame 100 and picking up the print medium M stacked on the knock-up plate 220 in the state that the stacking cassette 210 is coupled to the main frame 100.

Also, the medium feeding unit 200 includes a stacking tray 240 which is rotatable with respect to the main frame 100 and on which the print medium M may be stacked, and a second pick-up roller 250 picking up the print medium M stacked on the stacking tray 240. When the printing job starts, one topmost sheet of print medium M among the print media M stacked on the stacking cassette 210 or the stacking tray 240 is picked up by the first pick-up roller 230 or the second pick-up roller 250 and carried to the developing unit 400 and transfer unit 450.

The light scanning unit 300, the developing unit 400, and the transfer unit 450 form a visible image with a developer on the print medium M supplied from the medium feeding unit 200. In this embodiment, the light scanning unit 300, the developing unit 400, and the transfer unit 450 may form a mono-color image with a black developer. The light scanning unit 300 scans light based on print data for a printing job, the developing unit 400 forms a latent image based on light scanned by the light scanning unit 300 and a visible image based on the latent image, and the transfer unit 450 transfers the visible image formed by the developing unit 400 to the print medium M.

The light scanning unit 300 includes a light source, a lens, a polygon mirror, etc., and scans a light beam to a surface of an image carrying body 420 (to be described later) on the basis of print data, thereby forming a latent image on the image carrying body 420. The light scanning unit 300 is placed above the developing unit 400.

The developing unit 400 includes a developing unit housing 410 supported by the main frame 100 and accommodating a developer, the image carrying body 420 on which a latent image and a visible image are formed, an electric-charging roller 430 to uniformly charge the surface of the image carrying body 420 with electricity, and a developing roller 440 to form a visible image by supplying the developer to the latent image on the image carrying body 420.

Further, the developing unit 400 includes a cleaning blade 460 to clean a waste developer on the image carrying body 420, and a waste-developer carrying unit 470 to carry the waste developer collected by the cleaning blade 460 to a waste-developer container (not shown) installed at one end of the developing unit 400.

The image carrying body 420 is shaped like a cylindrical drum or roller extended along a widthwise axis (the 'Y' axis) of the print medium M perpendicular to a carrying direction (along the 'X' axis) of the print medium M. The image carrying body 420 may be embodied as a photosensitive body/organic photo conductor drum, on which a latent image of the electric-charging roller 430 and the light scanning unit 300 and the visible image of the developing roller 440 are formed.

When the printing job starts, the electric-charging roller 430 charges the outer circumference of the rotating image carrying body 420 with electricity having electric potential of certain polarity. The light scanning unit 300 scans a light beam on to the outer circumference of the image carrying body 420 charged as above, and thus forms a latent image due to a difference in electric potential.

The developing roller 440 supplies a developer from the developing unit housing 410 to the latent image of the image carrying body 420, so that the supplied developer can be attached to the latent image due to the difference in electric potential, thereby forming a visible image based on the developer.

The cleaning blade 460 removes the waste developer, which has not been transmitted to the print medium M by the transfer unit 450 and remains on the image carrying body 420, from the image carrying body 420, and moves it toward one side of the developer unit housing 410. The waste-developer carrying unit 470 may be embodied as an auger, so that the waste developer moved to one side of the developer unit housing 410 can be carried to and collected in the waste-developer container (not shown).

The transfer unit 450 may be embodied as a transfer roller extended and arranged corresponding to the image carrying body 420. The transfer unit 450 carries the print medium M supplied from the medium feeding unit 200, and transfers the visible image on the image carrying body 420 to the print medium M as a transfer bias is applied thereto.

The fixing unit 500 includes a heating roller 510 to generate heat, and a pressing roller 520 arranged in parallel with the heating roller 510 and forming a nip with the heating roller 510. The pressing roller 520 is pressed against the heating roller 510 by a predetermined elasticity so that heat and pressure can be applied to the nip formed between the heating roller 510 and the pressing roller 520, and fixing can be performed as the print medium M formed with an image by the developing unit 400 passes through the nip.

The duplex unit 600 carries the print medium M, one side of which has a first formed and fixed image, to the developing unit 400 again if the printing job is performed for both sides of the print medium M. The duplex unit 600 includes a plurality of rollers or guide frames, and carries the print medium M so that a side to face the image carrying body 420 can be a reverse side to the side having the previously formed image when the print medium M is carried to the image carrying body 420.

The discharging unit 700 discharges the print medium M, on which the image is fixed, to the outside of the image forming apparatus 1.

Meanwhile, a medium carrying frame 130 is supported by the main frame 100 and extended and installed between the developing unit 400 and the fixing unit 500, so that the print medium M can be guided to move from the developing unit 400 to the fixing unit 500. In this exemplary embodiment, the fixing unit 500 is arranged at a height substantially similar to the developing unit 400. Taking this into account, the medium carrying frame 130 is extended along an 'X' axis direction. However, the medium carrying frame 130 may be extended to be inclined downward at a predetermined angle from the developing unit 400 so that the print medium M can be more easily discharged from the developing unit 400.

The power supply 800 is arranged under the medium carrying frame 130, and supplies operating power to various elements of the image forming apparatus 1. The power supply 800 may be embodied as a switching mode power supply (SMPS), which receives external power and converts it into direct currents (DC) of various levels, thereby supplying them to respective elements.

With the above configuration, as the image forming apparatus 1 performs the printing job, heat is generated by operation of elements in the image forming apparatus 1, and the inner temperature of the image forming apparatus 1 becomes higher. Specifically, the heating roller 510 of the fixing unit 500 generates heat for fixing, and therefore a region adjacent to the fixing unit 500 shows the highest temperature in the image forming apparatus 1.

To more efficiently dissipate the heat of the fixing unit 500, the image forming apparatus 1 includes a channel 930 extended between the light scanning unit 300, the developing unit 400, and the transfer unit 450, and the fixing unit 500, and more particularly, between the developing unit 400 and the fixing unit 500.

Figure 2:
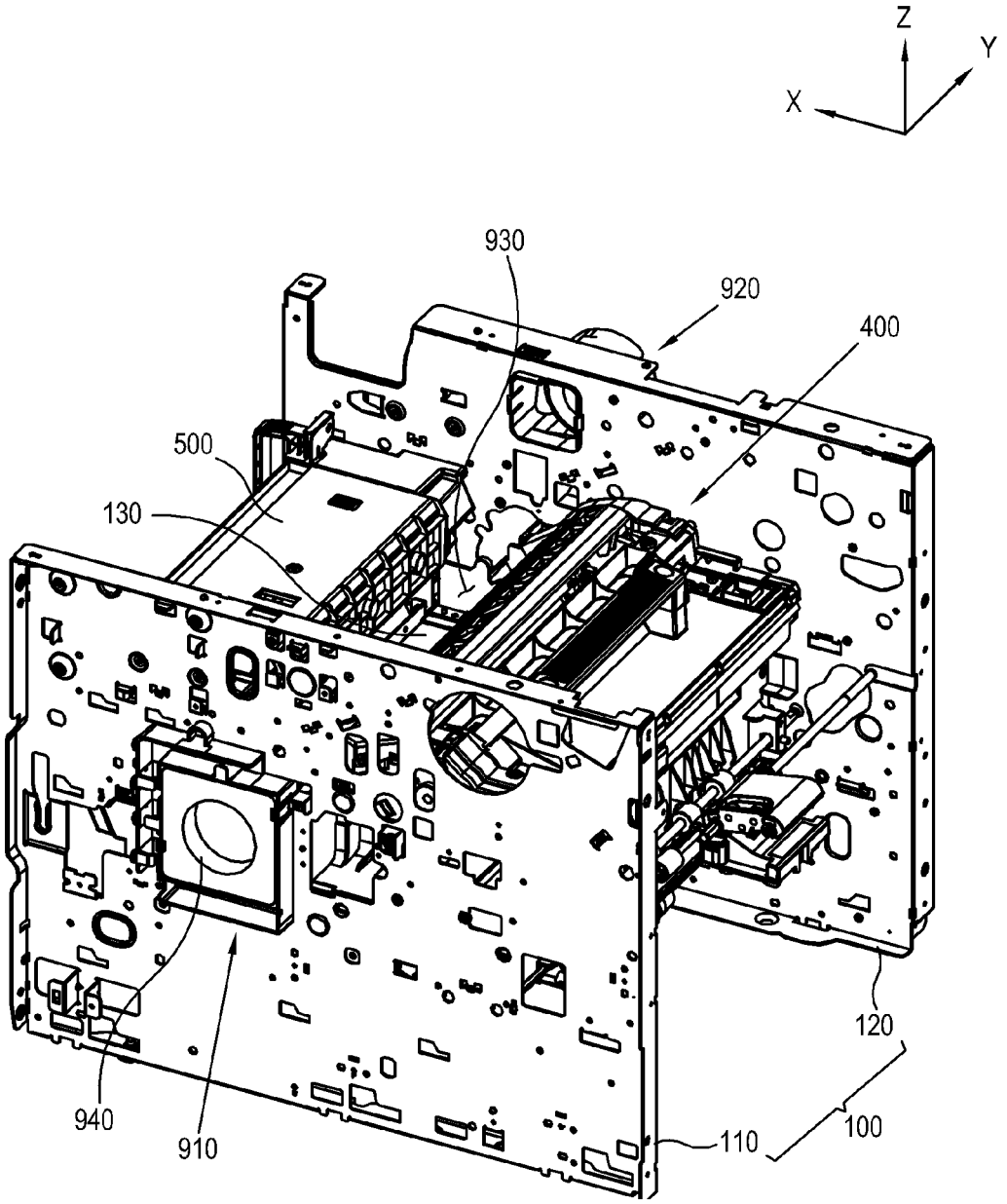
FIG. 2 is a partial perspective view showing a channel configuration of the image forming apparatus of FIG. 1.

Below, a detailed configuration of the channel 930 will be described with reference to FIG. 2. FIG. 2 is a partial perspective view showing a channel configuration of the image forming apparatus of FIG. 1. In this drawing, some elements are omitted for clarity of this explanation.

As illustrated in FIG. 2, the main frame 100 includes a first frame 110 to support one end of the developing unit 400 and the fixing unit 500, and a second frame 120, arranged to face the first frame 110, and to support the other end of the developing unit 400 and the fixing unit 500.

The first frame 110 and the second frame 120 respectively include an inhaling unit 910 and an exhaust unit 920 through which air can be interchanged with the exterior. Further, the channel 930 is extended from the inhaling unit 910 to the exhaust unit 920, so that air inhaled from the exterior through the inhaling unit 910 can move along the channel 930 and be exhausted to the exterior through the exhaust unit 920. Here, the channel 930 is extended along the lengthwise direction of the developing unit 400 and the fixing unit 500, and forms a substantially straight line.

A relative position between the inhaling unit 910 and the exhaust unit 920 is not limited. According to this exemplary embodiment, the height where the exhaust unit 920 is installed is a predetermined distance higher than the height where the inhaling unit 910 is installed. This is because the channel 930 is placed above the medium carrying frame 130 and the power supply 800 (see FIG. 3) is placed under the medium carrying frame 130.

The inhaling unit 910 is arranged so that air introduced through the inhaling unit 910 can move to the channel 930 and the power supply 800 (see FIG. 3) and cool the channel 930 and the power supply 800 placed under the channel 930. The exhaust unit 920 is arranged so that high temperature around the channel 930 and the light scanning unit 300 placed above the channel 930 can be exhausted to the outside. Thus, the installation height of the exhaust unit 920 is higher than that of the inhaling unit 910.

Also, the temperature of air exhausted from the exhaust unit 920 is relatively higher than that of air introduced into the inhaling unit 910, so that this arrangement can make a contribution to the flow where external air is introduced and then exhausted again to the outside of the image forming apparatus 1 via the channel 930.

The channel 930 in this exemplary embodiment is not formed by a separate member or frame, but instead formed by an empty space between the developing unit 400 and the fixing unit 500. Also, the medium carrying frame 130 is placed under the channel 930, and the light scanning unit 300 (see FIG. 1) is placed above the channel 930. However, the configuration of the channel 930 is not limited thereto. Alternatively, the channel 930 may be achieved by an air duct installed along the fixing unit 500, or formed by various structures such as a separate frame coupled to the main frame 100.

The inhaling unit 910 and the exhaust unit 920 may be achieved by vents respectively formed in the first frame 110 and the second frame 120, and at least one of the inhaling unit 910 and the exhaust unit 920 may be provided with a blow fan 940 to flow air through the channel 930.

With this configuration, cool air is introduced into the channel 930 through the inhaling unit 910, moves along the channel 930, and absorbs heat generated in the light scanning unit 300 (see FIG. 1), the developing unit 400, the fixing unit 500, the power supply 800 (see FIG. 3), etc., thereby increasing in temperature. Then, the air having a higher temperature is exhausted to the outside through the exhaust unit 920, so that the inner temperature of the image forming apparatus 1 can be lowered.

However, the cooling structure of this channel 930 may face the following situation.

As the image forming apparatus 1 performs a printing job as fast as possible, a relatively high amount of heat and pressure are needed for the fixing. That is, the amount of heat generated by the fixing unit 500 becomes larger. To secure cooling, the amount of air moving along the channel 930 has to be increased. To this end, the capacity of the blowing fan 940 or the width of the channel 930 has to be increased.

However, in this case, cost and energy consumption may increase, noise may increase, and the size of the image forming apparatus 1 may increase because a high performance blowing fan 940 is used.

Also, the temperature of air inhaled by the inhaling unit 910 is lower than that of air exhausted by the exhaust unit 920. Thus, air in the channel 930 shows a temperature deviation, i.e., the temperature increases in going from the inhaling unit 910 toward the exhaust unit 920. Such a temperature deviation causes the temperature of the fixing unit adjacent to the inhaling unit 910 to be relatively lower, and thus a fixing effect in this region is deteriorated, thereby causing the fixing to be defective. If the capacity of the blowing fan 940 is increased as described above, such defective fixing becomes more serious.

Also, the channel 930 is formed between the fixing unit 500 and the developing unit 400, and therefore heat generated by the fixing unit 500 is directly transferred to the developing unit 400 via the channel 930. Thus, the developer or the waste developer in the developing unit 400 may be solidified by heat, thereby causing a defective image or malfunction of the developing unit 400.

To minimize the above problems, the image forming apparatus 1 in this exemplary embodiment includes a guide member 1000 (see FIG. 3) installed on the channel 930 to guide an air flowing direction so that air inhaled through the inhaling unit 910 can move to the light scanning unit 300 (see FIG. 1), the developing unit 400, and the transfer unit 450 (see FIG. 1).

Figure 3:
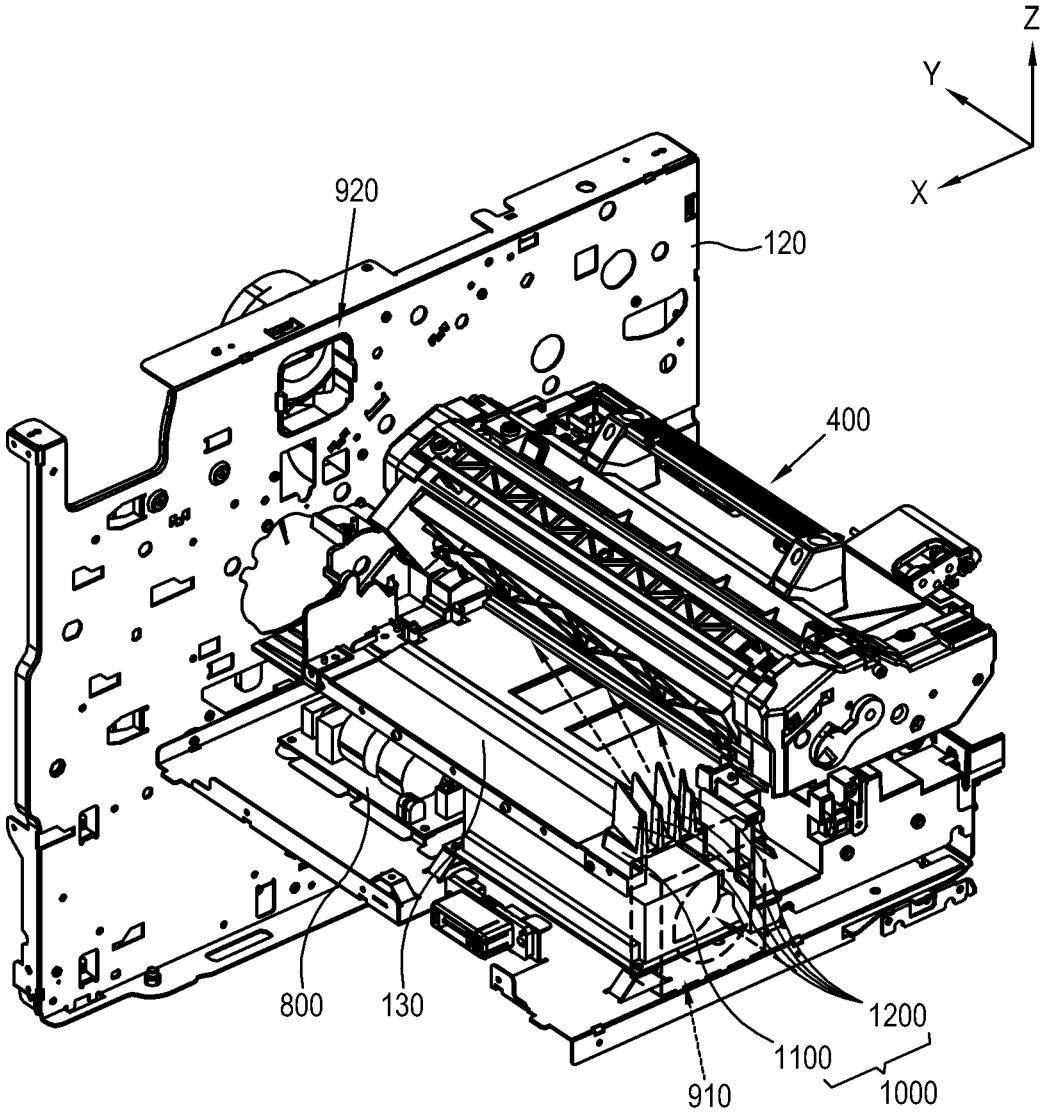
FIG. 3 is a partial perspective view showing a configuration of a guide member in the image forming apparatus of FIG. 1.

Below, the guide member 1000 will be described with reference to FIGS. 3 and 4. FIG. 3 is a partial perspective view showing a configuration of a guide member in the image forming apparatus of FIG. 1, and FIG. 4 is a plan view of the image forming apparatus of FIG. 3.

Figure 4:
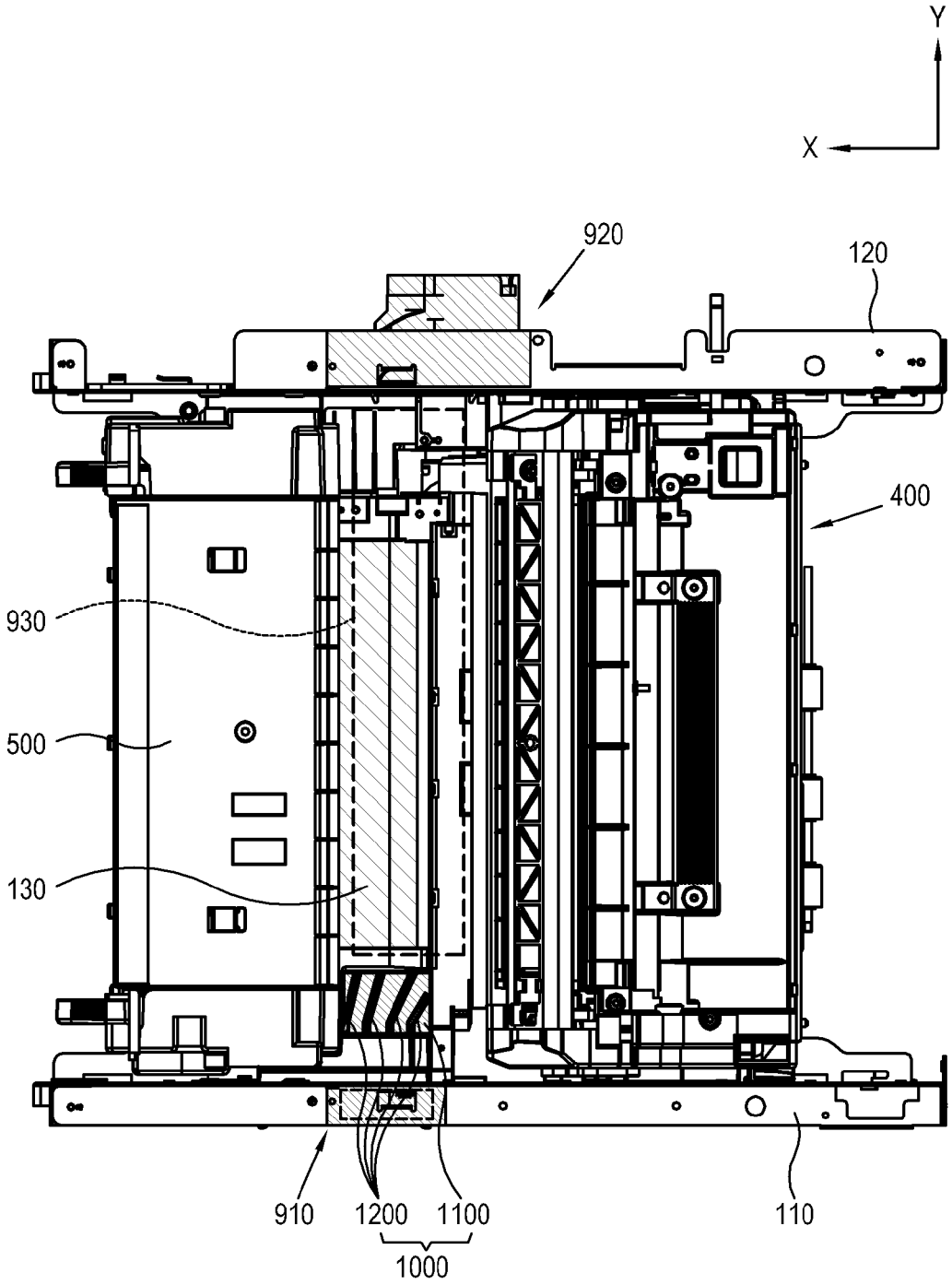
FIG. 4 is a plan view of the image forming apparatus of FIG. 3.

As illustrated in FIGS. 3 and 4, the guide member 1000 is formed on the channel 930 so as to be adjacent to the inhaling unit 910 and more particularly, is coupled to the medium carrying frame 130 placed under the channel 930. The guide member 1000 in this exemplary embodiment is configured separate from the medium carrying frame 130 and is coupled to the medium carrying frame 130, but not limited thereto.

Alternatively, the guide member 1000 and the medium carrying frame 130 may be formed as a single body, or the guide member 1000 may be coupled to inhaling unit 910 instead of the medium carrying frame 130. That is, the position of the guide member 1000 is not limited as long as it can guide air inhaled through the inhaling unit 910.

The guide member 1000 guides external air inhaled through the inhaling unit 910 and moving along the channel 930 toward the developing unit 400 instead of the fixing unit 500. The guide member 1000 includes a base 1100 coupled to the medium carrying frame 130, and a plurality of ribs 1200 standing on the base 1100 to guide air inhaled through the inhaling unit 910 to be distributed to a plurality of regions of the developing unit 400 along the lengthwise direction of the developing unit 400.

External air introduced through the inhaling unit 910 is divided into a plurality of air flows and moved along the channel formed between the plurality of ribs 1200. Here, the plurality of ribs 1200 are arranged in parallel along an axis corresponding to an extension direction of the channel 930, and each rib 1200 is extended to have a predetermined angle in a direction toward the developing unit 400 with respect to a lengthwise axis of the channel 930. Thus, air moving along the rib 1200 flows toward the light scanning unit 300 (see FIG. 1), the developing unit 400, and the transfer unit 450 instead of the fixing unit 500.

Here, the plurality of ribs 1200 are different in an extending angle. More specifically, the rib 1200 most adjacent to the developing unit 400 is extended to have a relatively large angle with respect to the extending axis of the channel 930. Thus, respective air flows moving between the plurality of ribs 1200 are guided to the plurality of regions of the developing unit 400 along the lengthwise direction of the developing unit 400. Thus, the guide member 1000 can uniformly divide and guide air introduced through the inhaling unit 920 along the lengthwise direction of the developing unit 400.

Figure 5:
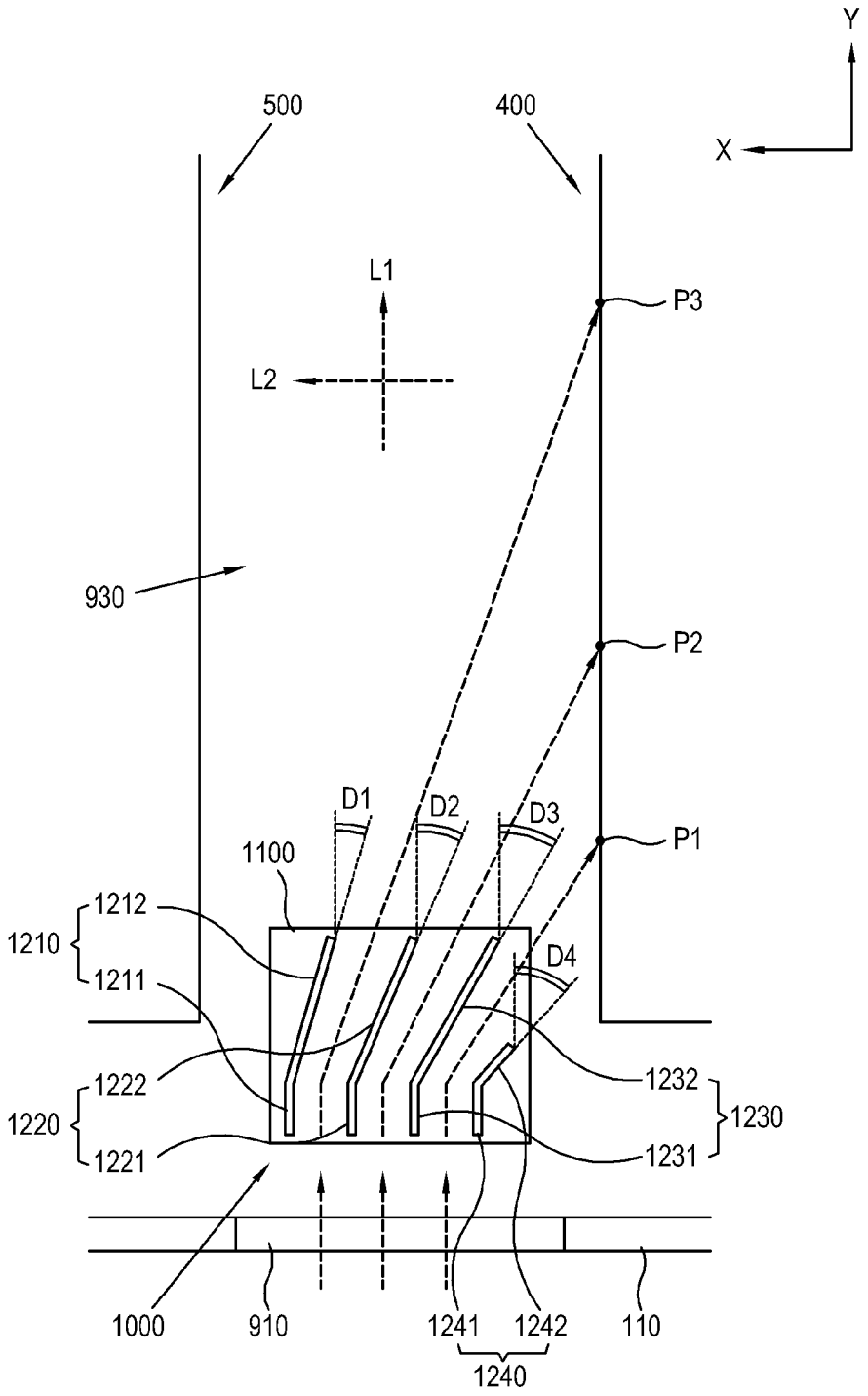
FIG. 5 is a plan view showing a configuration of a guide member of FIG. 4.

Below, detailed configurations of the ribs 1200 will be described with reference to FIG. 5. FIG. 5 is a plan view showing a configuration of a guide member of FIG. 4.

As shown therein, the channel 930, the developing unit 400 and the fixing unit 500 are extended along the Y-axis. Air introduced through the inhaling unit 910 moves along the channel 930.

The guide member 1000 includes the plurality of ribs 1210, 1220, 1230 and 1240 arranged in parallel on the base 1100. If the extending axis of the channel 930 is a first line L1 and a carrying axis of the print medium M perpendicular to the first line L1 is a second line L2, the first line L1 is parallel to the Y-axis and the second line L2 is parallel to the X-axis.

The plurality of ribs 1210, 1220, 1230, 1240 are arranged in parallel along the second line L2, and include a first rib 1210, a second rib 1220, a third rib 1230 and a fourth rib 1240 in order of which is closest to the fixing unit 500. Among the plurality of ribs 1210, 1220, 1230 and 1240, the fourth rib 1240 is closest to the developing unit 400. In this exemplary embodiment, the guide member 1000 includes four ribs 1210, 1220, 1230 and 1240. However, the present general inventive concept is not limited to this number of ribs.

Each rib 1210, 1220, 1230, 1240 includes, respectively, a first guide unit 1211, 1221, 1231, 1241 located in a direction of the inhaling unit 910, and, respectively, a second guide unit 1212, 1222, 1232, 1242 extended from the first guide unit 1211, 1221, 1231, 1241 in the direction of the channel 930.

The first guide units 1211, 1221, 1231, 1241 are extended in parallel with the extending axis of the channel 930, i.e., the first line L1 The first guide units 1211, 1221, 1231, 1241 guide air introduced through the inhaling unit 910 in a direction parallel with to the first line L1. The first guide units 1211, 1221, 1231 and 1241 of, respectively, the ribs 1210, 1220, 1230 and 1240 are all equally extended in parallel with the first direction L1, and air inhaled through the inhaling unit 910 is distributed to move in a direction parallel to the first line L1 along the channel formed between the first guide units 1211, 1221, 1231 and 1241.

The second guide units 1212, 1222, 1232, 1242 are extended as being bent at, respectively, a predetermined angle D1, D2, D3 and D4 with respect to the first line L1 in a direction from, respectively, the first guide units 1211, 1221, 1231, 1241 toward the developing unit 400. Thus, the second guide units 1212, 1222, 1232 and 1242 of, respectively, the ribs 1210, 1220, 1230 and 1240 are bent from, respectively, the first guide units 1211, 1221, 1231 and 1241, so that air distributed through the channels between the first guide units 1211, 1221, 1231 and 1241 can be guided to move toward the developing unit 400.

Thus, each rib 1210, 1220, 1230, 1240 includes, respectively, the first guide unit 1211, 1221, 1231, 1241 parallel to the first line L1, so that air resistance generated due to collisions between air and the rib 1210, 1220, 1230, 1240 can be reduced when a moving direction of air is changed by the second guide units 1212, 1222, 1232, 1242.

However, if the extending angles D1, D2, D3 and D4 of, respectively, the second guide units 1212, 1222, 1232 and 1242 of, respectively, the ribs 1210, 1220, 1230 and 1240 are the same, air passing through the guide member 1000 may be defined and guided by a relatively narrow region.

Accordingly, the extending angles D1, D2, D3 and D4 of, respectively, the second guide units 1212, 1222, 1232 and 1242 of, respectively, the ribs 1210, 1220, 1230 and 1240 are different from one another, so that air distributed by the guide member 1000 can be guided to reach the plurality of regions P1, P2 and P3 of the developing unit 400 along the lengthwise direction of the developing unit 400. That is, air is guided to a relatively large region of the developing unit 400, so that the developing unit 400 can be relatively uniformly cooled.

Here, the extending angles D1, D2, D3 and D4 of, respectively, the second guide units 1212, 1222, 1232 and 1242 of, respectively, the ribs 1210, 1220, 1230 and 1240 become larger as the corresponding ribs 1210, 1220, 1230 and 1240 become closer to the developing unit 400. That is, with respect to the first line L1, if the angle of the second guide unit 1212 of the first rib 1210 is D1, the angle of the second guide unit 1222 of the second rib 1220 is D2, the angle of the second guide unit 1232 of the third rib 1230 is D3, and the angle of the second guide unit 1242 of the fourth rib 1240 is D4, a relationship of 0<D1<D2<D3<D4 is satisfied.

Thus, air introduced through the inhaling unit 910 is distributed by the respective ribs 1210, 1220, 1230 and 1240, and moves toward the plurality of regions P1, P2 and P3 of the developing unit 400. Thus, without increasing the capacity of the blowing fan 940 or enlarging the width of the channel 930, the inner temperature of the image forming apparatus 1 can be efficiently lowered. Also, it is possible to prevent the developer or the waste developer in the developing unit 400 from being solidified by heat from the fixing unit 500.

Also, air introduced through the inhaling unit 910 is prevented from being directly guided to the fixing unit 500, so that defective fixing can be prevented.

In the above embodiment, the ribs 1210, 1220, 1230 and 1240 include, respectively, the first guide units 1211, 1221, 1231 and 1241 extended in parallel with the first line L1, and, respectively, the second guide units 1212, 1222, 1232 and 1242 bent from, respectively, the first guide units 1211, 1221, 1231 and 1241 at, respectively, predetermined angles D1, D2, D3 and D4 with respect to the first line L1, but not limited thereto. Alternatively, there may be various configurations where the guide member 1000 guides the flowing direction of air so that air inhaled through the inhaling unit 910 can move toward the light scanning unit 300, the developing unit 400, and the transfer unit 450.

Figure 6:
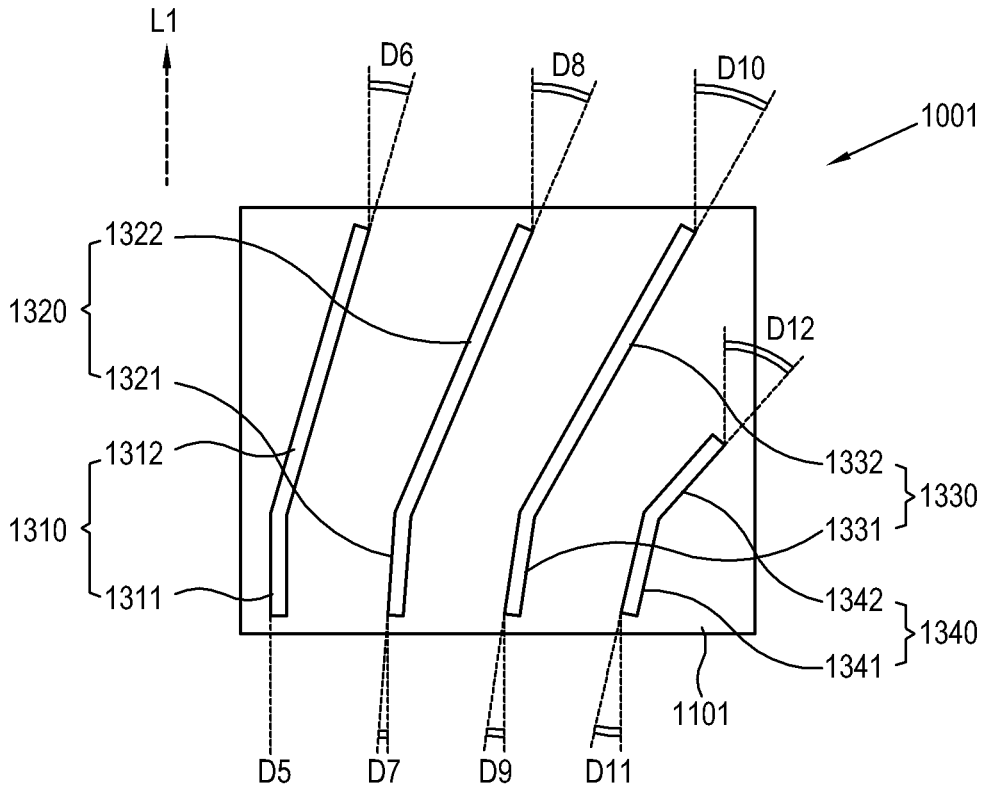
FIG. 6 is a plan view showing a configuration of a guide member according to an exemplary embodiment of the present general inventive concept.
Figure 7:
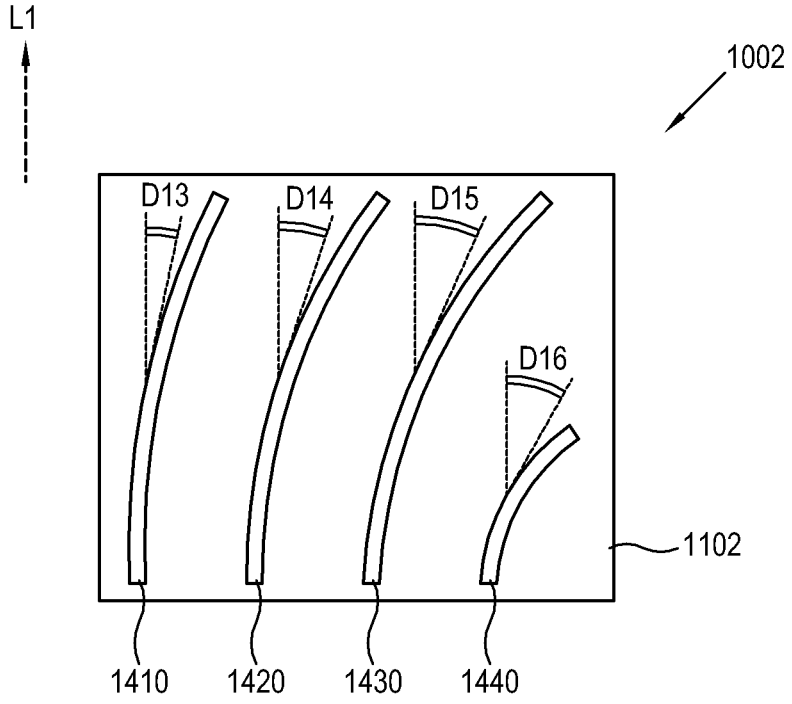
FIG. 7 is a plan view showing a configuration of a guide member according to an exemplary embodiment of the present general inventive concept.

Below, alternative configurations will be described with reference to FIGS. 6 and 7. FIGS. 6 and 7 are plan views showing configurations of guide members according to other exemplary embodiments.

As illustrated in FIG. 6, a guide member 1001 in this exemplary embodiment includes a plurality of ribs 1310, 1320, 1330 and 1340 installed on a base 1101, and each rib 1310, 1320, 1330, 1340 includes, respectively, a first guide unit 1311, 1321, 1331, 1341 and, respectively, a second guide unit 1312, 1322, 1332, 1342 bent and extended from, respectively, the first guide unit 1311, 1321, 1331, 1341.

The exemplary embodiment illustrated in FIG. 6 is similar to the exemplary embodiment illustrated in FIG. 5 except that the first guide units 1311, 1321, 1331 and 1341 of, respectively, the ribs 1310, 1320, 1330 and 1340 have different angles. In order of being closest to the fixing unit 500, if the angle of the first guide unit 1311 of the first rib 1310 with respect to the first line L1 is D5, the angle of the first guide unit 1321 of the second rib 1320 with respect to the first line L1 is D7, the angle of the first guide unit 1331 of the third rib 1330 with respect to the first line L1 is D9, and the angle of the first guide unit 1341 of the fourth rib 1340 with respect to the first line L1 is D11, a relationship of 0≤D5<D7<D9<D11 is satisfied. Therefore, air resistance generated due to collisions with the ribs 1310, 1320, 1330, 1340 can be reduced more than that of the exemplary embodiment illustrated in FIG. 5.

Further, if the angle of the second guide unit 1312 of the first rib 1310 with respect to the first line L1 is D6, the angle of the second guide unit 1322 of the second rib 1320 with respect to the first line L1 is D8, the angle of the second guide unit 1332 of the third rib 1330 with respect to the first line L1 is D10, and the angle of the second guide unit 1342 of the fourth rib 1340 with respect to the first line L1 is D12, a relationship of 0<D6<D8<D10<D12 is satisfied.

Here, the air flow moves along the first guide units 1311, 1321, 1331 and 1341 and then moves toward the developing unit 400 along the second guide units 1312, 1322, 1332 and 1342, and therefore relationships of D5<D6, D7<D8, D9<D10, and D11<D12 are satisfied.

The exemplary embodiment illustrated in FIG. 7 is similar to the exemplary embodiment illustrated in FIG. 5 except that, as illustrated in FIG. 7, ribs 1410, 1420, 1430 and 1440 standing on the base 1102 of a guide member 1002 may be extended in the form of a curved line instead of a straight line.

In order of being closest to the fixing unit 500, if the plurality of ribs 1410, 1420, 1430 and 1440 include a first rib 1410, a second rib 1420, a third rib 1430 and a fourth rib 1440, each rib 1410, 1420, 1430, 1440 is bent and extended as being rounded having a predetermined curvature with respect to the first line L1 in a direction toward the developing unit 400.

At this time, if an angle between a tangent line of the first rib 1410 and the first line L1 is D13, an angle between a tangent line of the second rib 1420 and the first line L1 is D14, an angle between a tangent line of the third rib 1430 and the first line L1 is D15, and an angle between a tangent line of the fourth rib 1440 and the first line L1 is D16, a relationship of 0<D13<D14<D15<D16 is satisfied. That is, the curvature of each rib 1410, 1420, 1430, 1440 becomes larger for ribs closer to the developing unit 400.

Thus, there may be various configurations of the guide member according to the present general inventive concept.

As described above, without increasing the capacity of the blowing fan 940 installed in the inhaling unit 910, it is possible to lower the temperature of the image carrying body 420 and the waste-developer carrying unit 470 of the developing unit 400.

For example, under the condition that temperature is 30° C. and humidity is 85%, if there is no guide member when the image forming apparatus 1 performs a duplex printing job for the print medium M, it is as follows. In that case, the left and right sides of the image carrying body 420 respectively had saturated temperatures of about 55.8° C. and 56° C., and the left and right sides of the waste-developer carrying unit 470 respectively had saturated temperatures of about 55° C. and 55.5° C.

In this status, if the guide member 1000 according to an exemplary embodiment is used, the left and right sides of the image carrying body 420 respectively had lowered saturated temperatures of about 47.5° C. and 47.8° C., and the left and right sides of the waste-developer carrying unit 470 respectively had lowered saturated temperatures of about 50° C. and 52° C. That is, according to an exemplary embodiment of the present general inventive concept, it is possible to lower the temperatures of the image carrying body 420 and the waste-developer carrying unit 470 by about 3.5 to 8.3° C.

Accordingly, the inner temperature of the image forming apparatus 1 can be effectively reduced by a simple structure.

In the foregoing exemplary embodiment described with reference to FIG. 5 or the like, each rib 1210, 1220, 1230, 1240 is bent once from, respectively, the first guide unit 1211, 1221, 1231, 1241 to, respectively, the second guide unit 1212, 1222, 1232, 1242, but the present general inventive concept is not limited thereto. Each rib may be bent twice or more.

As apparent from the above description, there is provided a guide member 1000, 1001, or 1002 having a simple structure of distributing and guiding air introduced into an inhaling unit 910 to a developing unit 400, so that an inner temperature of an image forming apparatus 1 can be efficiently lowered.

Also, this guide member 1000, 1001, or 1002 does not need any separate driving power, and thus it is free from additional energy consumption, noise and vibration.

Further, the relatively cool external air introduced into the inhaling unit 910 is guided to the developing unit 400, so that fixing heat from a fixing unit 500 can have a minimum effect on a developer or waste developer of the developing unit 400. Thus, it is possible to prevent a defective image, and to prevent trouble with operation of the developing unit 400 or waste-developer collecting unit 470 due to solidification of the developer or waste developer.

Further, the relatively cool external air introduced into the inhaling unit 910 is prevented from having a direct effect on the fixing unit 500, so that non-uniformity in a fixing temperature between left and right sides of the fixing unit 500 can be minimized, thereby preventing faulty fixing.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a main frame having an inhaling unit formed at one side of the main frame and an exhaust unit formed at another side of the main frame;

a medium feeding unit supported by the main frame and configured to supply a print medium;

an image forming unit supported by the main frame and configured to form an image on the print medium supplied by the medium feeding unit;

a fixing unit supported by the main frame and configured to fix the image formed by the image forming unit on the print medium;

a channel extended along a lengthwise direction of the fixing unit, between the image forming unit and the fixing unit, and configured to guide air inhaled through the inhaling unit to move to the exhaust unit so that the air in the channel is exhausted to an exterior through the exhaust unit; and a guide member installed between the image forming unit and the fixing unit within the channel, and having a configuration so that none of the air inhaled through the inhaling unit is guided by the guide member toward the fixing unit, wherein the guide member comprises a plurality of ribs configured to guide the air inhaled through the inhaling unit to the image forming unit;

wherein each rib comprises a first guide unit arranged at a side of the inhaling unit and extended parallel to an extending direction of the channel, and a second guide unit bent from end of the first guide unit toward the image forming unit; and wherein the first guide units are equal length.

2. The image forming apparatus according to claim 1, wherein the channel is formed along a lengthwise direction of the image forming unit.

3. The image forming apparatus according to claim 2, wherein the ribs guide the air inhaled through the inhaling unit to be distributed into a plurality of regions of the image forming unit along the lengthwise direction of the image forming unit.

4. The image forming apparatus according to claim 3, wherein the plurality of ribs are extended to respectively have different angles with respect to a first line parallel to the extending direction of the channel.

5. The image forming apparatus according to claim 4, wherein the second guide units of the respective ribs have different extending angles with respect to the first line.

6. The image forming apparatus according to claim 5, wherein the first guide units of the respective ribs extend to have different angles with respect to the first line, and for each rib, the extending angle of the second guide unit of a rib is larger than the corresponding extending angle of the first guide unit of the rib.

7. The image forming apparatus according to claim 4, wherein each of the plurality of ribs has one end arranged along a second line perpendicular to the first line, the second line being parallel with a carrying direction of the print medium.

8. The image forming apparatus according to claim 7, wherein the extending angle of a first rib with respect to the first line is larger than the extending angle of a second rib with respect to the first line, and the first rib is closer to the image forming unit than the second rib.

9. The image forming apparatus according to claim 7, wherein the plurality of ribs are bent and extended as being rounded toward the image forming unit, and an angle between a tangent line of a first rib and the first line is larger than the angle between the tangent line of the second rib and the first line, and the first rib is closer to the image forming unit than the second rib.

10. The image forming apparatus according to claim 2, wherein the image forming unit comprises:

a developing unit including an image carrying body on which a latent image is formed, arranged in parallel with the fixing unit, and to form the image with a developer on the image carrying body; and a light scanning unit installed above the developing unit and to form a latent image based on image data on the image carrying body, and the channel is formed under the light scanning unit.

11. The image forming apparatus according to claim 10, wherein the moving path is extended in the form of a straight line between the developing unit and the fixing unit along the lengthwise direction of the at least one of the developing unit and the fixing unit.

12. The image forming apparatus according to claim 10, further comprising a medium carrying frame installed under the channel and supporting the print medium carried from the developing unit to the fixing unit, wherein the guide member is coupled to the medium carrying frame.

13. The image forming apparatus according to claim 10, wherein the exhaust unit is installed at a position relatively higher than the inhaling unit.

14. The image forming apparatus according to claim 13, further comprising a power supply installed under a medium carrying frame and to supply power, wherein the inhaling unit is arranged at a height to supply air inhaled from an exterior to the channel and the power supply.

15. The image forming apparatus according to claim 13, wherein the exhaust unit is arranged at a height to exhaust air from the channel and the light scanning unit to an exterior of the image forming apparatus.

16. The image forming apparatus according to claim 2, wherein the main frame comprises:

a first frame supporting one end of the image forming unit and the fixing unit; and a second frame facing the first frame and supporting the other end of the image forming unit and the fixing unit, and the inhaling unit and the exhaust unit are installed in the first frame and the second frame, respectively.

17. The image forming apparatus according to claim 16, wherein at least one of the inhaling unit and the exhaust unit comprises a blowing fan to move the air through the channel.

18. An image forming apparatus comprising:

an inhaling unit formed at a side of the image forming apparatus and configured to transfer an air from an exterior of the image forming apparatus to a channel at an interior of the image forming apparatus in a direction perpendicular to the side of the image forming apparatus;

an exhaust unit formed at another side of the image forming apparatus;

a plurality of guide ribs disposed in the channel of the image forming apparatus in a path of the air transferred by the inhaling unit, each of the plurality of guide ribs having a portion angled with respect to the side of the image forming apparatus and configured to change a direction of the air transferred by the inhaling unit;

an image forming unit configured to form an image on a print medium; and a fixing unit configured to fix the image formed by the image forming unit to the print medium and disposed in the interior of the image forming apparatus such that the plurality of guide ribs have a configuration so that none of the air transferred by the inhaling unit is guided by the plurality of guide ribs toward the fixing unit, wherein the channel is disposed between the image forming unit and the fixing unit, is extended along a lengthwise direction of the fixing unit, and is configured to guide air inhaled through the inhaling unit to move to the exhaust unit so that the air in the channel is exhausted to an exterior through the exhaust unit, wherein each of the plurality of guide ribs comprises a first guide portion arranged at a side of the inhaling unit and extended parallel to the lengthwise direction of the fixing unit, and a second guide portion bent from end of the first guide portion toward the image forming unit;

wherein the first guide portions are equal length.

19. The image forming apparatus according to claim 18, wherein the image forming unit is disposed in the interior of the image forming apparatus such that the plurality of guide ribs are configured to change the direction of the air to be toward the image forming unit.

20. The image forming apparatus according to claim 18, wherein the first guide portion has a first end facing the inhaling unit and a second end facing away from the inhaling unit; and the second guide portion is connected to the second end of the first guide portion and extending at a first angle with respect to the side of the image forming apparatus and configured to change the direction of the air according to the first angle, wherein the first angle of each respective second guide portion is different from the first angle of each other respective second guide portions.

21. The image forming apparatus according to claim 20, wherein each respective first guide portion extends in a direction perpendicular to the side of the image forming apparatus.

22. The image forming apparatus according to claim 20, wherein each respective first guide portion extends at a second angle with respect to the side of the image forming apparatus, wherein the second angle of each respective first guide portion is different from the second angle of each other respective first guide portions.

23. The image forming apparatus according to claim 18, wherein the plurality of ribs each include a first end facing the inhaling unit, extending in a curved shape away from the inhaling unit, and configured to change the direction of the air according to a curvature of the curved shape, wherein the curvature of each respective guide rib is different from the curvature of each other respective guide ribs.

* * * * *